US005111984A

United States Patent [19]

Niedbala

[11] Patent Number: 5,111,984

[45] Date of Patent: May 12, 1992

[54] METHOD OF CUTTING WORKPIECES HAVING LOW THERMAL CONDUCTIVITY

[75] Inventor: Patrick J. Niedbala, Livonia, Mich.

[73] Assignee: Ford Motor Company, Dearborn, Mich.

[21] Appl. No.: 597,212

[22] Filed: Oct. 15, 1990

[51] Int. Cl.[5] ..... B26F 3/00

[52] U.S. Cl. ..... 225/1; 225/93.5

[58] Field of Search ..... 225/1, 93.5; 51/320; 83/16

[56] References Cited

U.S. PATENT DOCUMENTS

| | | | |
|---|---|---|---|
| 3,676,963 | 7/1972 | Rice et al. | 51/320 |
| 3,878,978 | 4/1975 | Martinek | 225/93.5 |
| 4,389,820 | 6/1983 | Fong et al. | 51/320 |
| 4,415,107 | 11/1983 | Palmieri | 225/93.5 |
| 4,696,421 | 9/1987 | Dürr | 225/1 |
| 4,806,171 | 2/1989 | Whitlock et al. | 51/320 |

*Primary Examiner*—Frank T. Yost

*Attorney, Agent, or Firm*—Joseph M. Malleck; Roger L. May

[57] ABSTRACT

A method of cutting and severing any portion of a nonferrous workpiece having a thickness generally equal to or less than 0.90 inches and a thermal conductivity significantly less than metal. A focused jet of $CO_2$ crystallites (density of 0.03-0.4 g/cm$^3$) and a gas, pressurized to at least 100 psi, is translated across the workpiece at a velocity of 250-1000 mm/sec, the jet having a converging focus (0.1-0.5 in$^2$) substantially near the surface of said workpiece (i) to thermally embrittle the workpiece immediately surrounding said focus, and (ii) to fracture the workpiece at said focus by air pressure.

6 Claims, 2 Drawing Sheets

METHOD OF CUTTING WORKPIECES HAVING LOW THERMAL CONDUCTIVITY

BACKGROUND OF THE INVENTION

1. Technical Field

This invention relates to the technology of rapidly cutting low thermal conductivity materials such as foams, plastics, and fabrics, and more particularly to the technology of using fluidized jets to remove or sever surface discontinuities.

2. Discussion of the Prior Art

Conventional methods of removing surface discontinuity, such as edge salvage from plastics or foam bodies used in seating material for automobiles, has comprised either the manual use of razor sharp knives or use of heated wires as a hybrid mechanical and thermal process. Each of these methods is intensive in labor requirements, and thus high in cost, and lacks accuracy in cutting or severing because of manual guidance.

Similarly, sand or grit blasting has been carried out for years to remove surface discontinuities; this is a mechanical impact process. The particles may include a variety of solid materials such as sand, glass beads, walnut shells, and may include nonsolids such as steam and chemical solvents. The problem with this straight mechanical approach is that it not only removes discontinuities, but it also abrades desirable parts of the workpiece itself and cannot achieve clean-cut straight edges.

Water jets have recently been used to cut soft materials; this again is a straight mechanical process that uses the high pressure of a dense liquid, at room temperature, to carry out the severing. The problem with a water jet is that it also provides an imprecise edge cut, often a ragged fracture, and is unable to cut through many types of low thermal conductivity workpieces.

A modern approach to removing surface discontinuities is disclosed in U.S. Pat. No. 3,676,963, which attempts to clean burrs or other flashing from a metallic or plastic workpiece by using the mechanical impact of solid ice particles sprayed thereagainst without convergence. The kinetic energy of the solid ice particles fractures the burrs by repeated impact which exceed the bending fatigue limit of the burrs. This mechanical impact process is assisted by the high density of the ice particles in the range of 0.89–0.98 g/cm$^3$ and by the cooling effect of the ice particles. The particles must be sized relatively large, such as 16–20 mesh, and conveyed in a fluidized stream of liquid nitrogen or air. Unfortunately, the particles, being relatively large and sprayed in a nonconverging pattern, do not cut straight edges but instead fracture fragments of the workpiece by kinetic energy. The ice particles are sprayed from a straight nozzle having identical inlet and outlet diameters or by use of an aspirator nozzle having a venturi throat; each nozzle employs a small orifice concentric with the nozzle throat to promote expansion and therefore the spraying effect.

The principal goal of this invention is to provide a method of robotically cutting low thermal conductivity materials that are not subject to removal by frangible bending fatigue.

SUMMARY OF THE INVENTION

This invention uses the inherent qualities of dry ice in a unique manner, dry ice being pure liquid $CO_2$ which has been expanded under pressure to form a snow-like material that is immediately densified into pellets or larger forms. Dry ice has a normal temperature of minus 50° F. to minus 110° F. at atmospheric pressures; if the dry ice is warmer than −50° F., it has difficulty crystallizing and tends to sublime. The unique manner in which dry ice is used herein is threefold: (i) controlling the pressure of the gaseous vehicle carrying the $CO_2$ solids, (ii) mixing the $CO_2$ particles with the gaseous vehicle in a nozzle so that the $CO_2$ exits from the nozzle as low-density crystallites, and (iii) concentrating the crystallites in a focused jet so that the focus point is at or near the surface of the workpiece to be cut resulting in simultaneous cryogenic embrittlement of the workpiece and separation by the force of the gaseous fluid carrying the low density crystallites.

More particularly, the method is one for cutting and severing a workpiece having a thermal conductivity considerably less than metal; it comprises translating a jet of pressurized air carrying $CO_2$ crystallites, maintained at a temperature of −9° to −110° F., across the workpiece at a translating velocity of 250–1000 mm/sec and an exit velocity of 1600–2000 ft/sec, the jet having a convergence focus substantially near the surface of the workpiece (i) to thermally embrittle the workpiece immediately surrounding the focus, and (ii) to fracture the workpiece at the focus by air pressure.

Preferably, the pressure of the air supply is in the range of 100–225 psi and the jet is created by a nozzle having an internal conical surface with a convergence angle of about 9°–½° that promotes mixing to insure crystallites having a density of in the range of 0.03 g/cm$^3$ to 0.4 g/cm$^3$.

BRIEF DESCRIPTION OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

DETAILED DESCRIPTION AND BEST MODE

Figure 1:
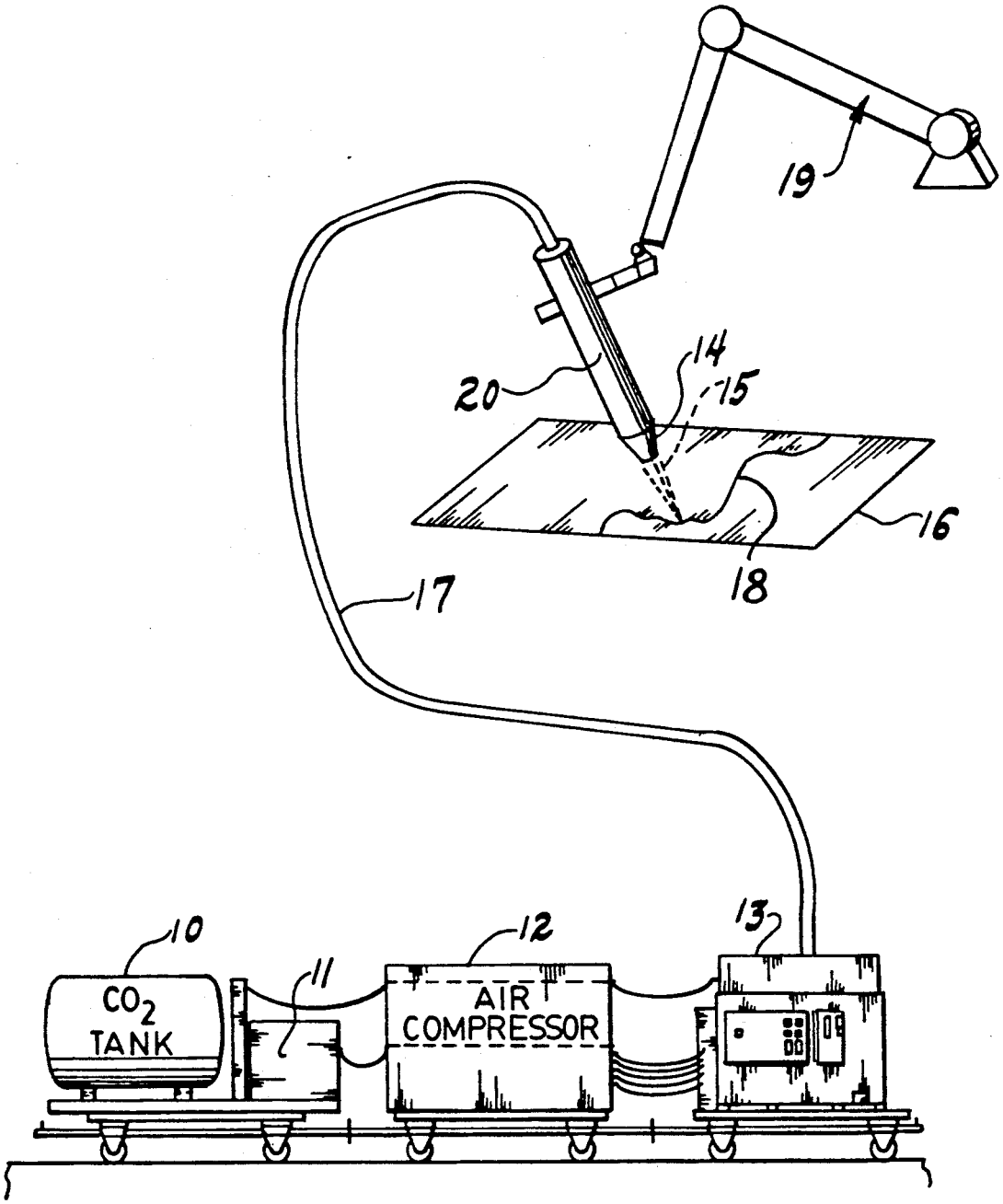
FIG. 1 is a schematic illustration of an apparatus useful in carrying out the invention.
Figure 2:
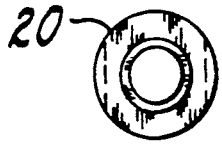
FIGS. 2–4 are, respectively, left-end, elevational, and right-end views of a nozzle used with this invention.
Figure 3:
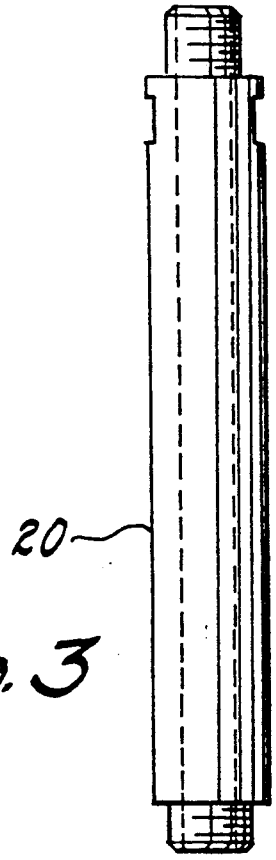
Figure 4:
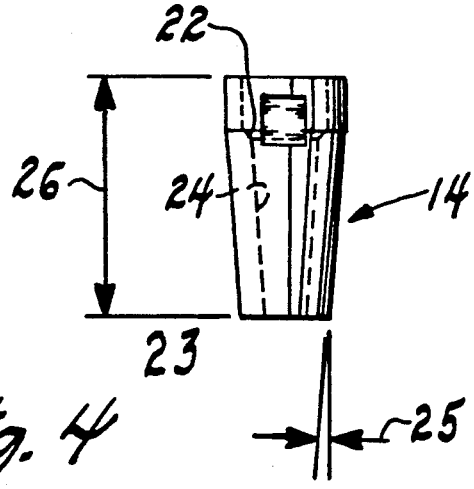

Turning to FIG. 1, pure liquid $CO_2$ (refrigerated by unit 11) is drawn from a supply 10 and expanded under pressure at 13 using an air compressor 12 to form a snow-like material that is densified by extrusion through a foraminous plate or by counter rotation in a drum. The densified pellets or particles are maintained at a temperature of −90° F. by use of refrigeration and pressure in mechanism 13. The ice particles are drawn from a reservoir within mechanism 13 and conveyed by compressed air along an insulated tube 17 to a converging nozzle 14. The air and dry ice are mixed within the nozzle 14 in a manner causing the dry ice to be converted to crystallites and delivered in a focused jet or beam 15 to the workpiece fabric 16. The nozzle is translated (preferably by a robot 19 acting on a metallic nozzle support 20) relative to the workpiece in a lateral direction so that the focus of the crystallite/air mixture can cut and sever a predetermined line 18 along the workpiece.

The dry ice maintained within the reservoir preferably has a particle size of 16–20 mesh (5 mm×3 mm).

The compressed air (or other equivalent gaseous inert fluid such as nitrogen) that is used to convey the particles is pressurized to the level of 100–225 psi and has a purity of at least 99.99%. If the propelling gas pressure is less than 100 psi, the cutting action is impaired and the nozzle throat clogged. The higher the pressure, the more desirable the action.

The nozzle 14 has a chamfered inlet area 22 considerably larger than the exit area 23 by a ratio of 1.5 to 1: the internal walls of such nozzle have a conical configuration defining a converging angle 25 in the range of 9°–10°. The length 26 of the nozzle is about 2.0 inches. The internal conical wall of the nozzle is not interrupted by any restraining orifices or expansion throat contours. This convergent nozzle configuration is useful in attaining a focus area of 0.1–0.5 $in^2$ at a nozzle spacing of 3–4 inches from the workpiece. If a different nozzle configuration is utilized, the spacing range may be varied while still attaining the focus area.

As a result, the dry ice (having a density of at least 0.9 $g/cm^3$ as delivered to the nozzle) and compressed air are thermodynamically mixed within the length of the nozzle interior to convert the solid ice particles to lower density crystallites in the range of 0.03–0.4 $g/cm^3$, equivalent to snowflakes. Thus, upon impact with the workpiece, the low density crystallites have greater thermal transmitting characteristics because they are akin to a slush facilitating greater transitory thermal exchange. If a density of less than 0.03 $g/cm^3$ is used, the particles tend to sublimate and lose any shock effect. If the density is greater than 0.4 $g/cm^3$, the workpiece becomes excessively brittle and fractures in an unwanted manner or renders a jagged saw-tooth cut. The gas pressure is maintained at a high level within the focused point area sufficient to sever the type of workpiece being operated upon.

The kind of workpieces that can be severed and cut by use of the aforementioned jet 15 include low thermal conductivity type of materials such as plastic foams, rigid plastics, rubber, flexible vinyls, and synthetic fabrics. This invention works well with rigid plastics less than 0.045 inch in thickness, less than 0.06 inch with synthetic fabrics, and less than 0.09 inch with vinyls or plastic foams.

The distance between the exit orifice of the nozzle and the focus point at which cutting takes place is preferably in the range of 3–4 inches. The focus point should be within a distance of ±0.25 inches of the workpiece surface for optimum cutting capability. The nozzle itself may be robotically carried to traverse the workpiece at a velocity in the range of 250–1000 mm/sec. If a velocity in excess of such range is utilized, intermittent flash will be left along the workpiece surface; if a slower translating velocity is used, the workpiece will be degraded by scrathes and dents.

To corroborate the advantages of this invention within the critical ranges of this invention, various samples processes were carried out differing with respect to process parameters as listed in Table I. As a result of such tests, it is apparent that density of the $CO_2$ particles at impact, focus of the diameter, the distance of the focus of the jet from the work surface, the gas pressure utilized, the temperature of the crystallites, and the thickness of the workpiece play a role in being able to optimally carry out cutting and severing according to this invention.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

TABLE I

| Example | Propelling Gas Pressure (psi) | Jet Velocity (ft/sec) | Density of $CO_2$ Particles ($g/cm^3$) | Workpiece Material | Workpiece Thickness (") | Focus Diameter (") | Translating Velocity mm/sec | Cutting Evaluation |
|---|---|---|---|---|---|---|---|---|
| 1 | 200 | 1920 | .05 | plastic foam | .80 | .25 | 800 | excellent |
| 2 | 200 | 1920 | .05 | synthetic fabric | .05 | .25 | 800 | excellent |
| 3 | 200 | 1920 | .05 | rigid plastic | .040 | .25 | 800 | excellent |
| 4 | 200 | 1920 | .05 | flexible vinyl | .080 | .25 | 800 | excellent |
| 5 | 80 | 1300 | .06 | synthetic fabric | .05 | .25 | 800 | no |
| 6 | 200 | 1920 | .09 | synthetic fabric | .05 | .25 | 800 | no |
| 7 | 200 | 1920 | .01 | synthetic fabric | .05 | .25 | 800 | no |
| 8 | 200 | 1920 | .01 | synthetic fabric | .08 | .25 | 800 | no |
| 9 | 200 | 1920 | .01 | synthetic fabric | .05 | .08 | 800 | no |
| 10 | 200 | 1920 | .01 | synthetic fabric | .05 | .6 | 800 | no |
| 11 | 200 | 1920 | .01 | synthetic fabric | .05 | .25 | 250 | good |
| 12 | 200 | 1920 | .01 | synthetic fabric | .05 | .25 | 1000 | excellent |
| 13 | 200 | 1920 | .01 | synthetic fabric | .05 | .25 | 1200 | no |

I claim:

1. A method of cutting and severing any portion of a nonferrous workpiece having a thickness generally less than 0.090 inches and a thermal conductivity significantly less than metal, comprising:

translating a focused jet of $CO_2$ crystallites and a gas, pressurized to at least 100 psi, across said workpiece at a translating velocity of 250–1000 mm/sec, said crystallites being intermixed during jet formation to have a density at impact with the workpiece of about 0.03–0.4 $g/cm^3$, said jet having a converging focus substantially near the surface of said workpiece (i) to thermally embrittle said workpiece immediately surrounding said focus, and (ii) to fracture said workpiece at said focus by gas pressure.

2. The method as in claim 1, in which said crystallites having the character of snowflakes and are focused to a cutting diameter of 0.1–0.5 $in^2$.

3. The method as in claim 1, in which said workpiece is comprised of a material selected from the group consisting of rigid plastics, soft vinyl, plastic foam, rubber, and synthetic fabrics.

4. The method as in claim 1, in which the workpiece is synthetic fabric and its thickness is less than 0.06 inches.

5. The method as in claim 1, in which the workpiece is soft vinyl or plastic foam and its thickness is less than 0.90 inches.

6. The method as in claim 1, in which the workpiece is rigid plastic and the thickness of the workpiece to be cut and severed is in the range of 0.001–0.045 inches.

* * * * *